United States Patent [19]

Ruf

[11] 4,037,455

[45] July 26, 1977

[54] PROCESS FOR PRODUCING METAL RINGS

[75] Inventor: Max Ruf, Obereisesheim, Germany

[73] Assignee: Audi NSU Auto Union Aktiengesellschaft, Germany

[21] Appl. No.: 698,744

[22] Filed: June 22, 1976

[30] Foreign Application Priority Data

June 28, 1975 Germany ..... 2528905

[51] Int. Cl.[2] ..... B21D 43/28

[52] U.S. Cl. ..... 72/324; 72/379; 113/116 V; 113/116 BB

[58] Field of Search ..... 72/379, 367, 324, 348, 72/347; 29/157.4; 113/116 UT, 116 V, 116 Y, 116 BB; 418/142

[56] References Cited

U.S. PATENT DOCUMENTS 1,912,000 5/1933 Kloss et al. ..... 113/116 V

FOREIGN PATENT DOCUMENTS 1,927,317 1/1970 Germany ..... 72/348

*Primary Examiner*—James R. Duzan

*Attorney, Agent, or Firm*—Kane, Dalsimer, Kane, Sullivan and Kurucz

[57] ABSTRACT

Two metal rings are produced having a concave C-shaped cross section, open in an axial direction. In particular, annular sealing members are formed by deep-drawing a strip, the outside diameter of one ring being slightly smaller than the inside diameter of the other ring.

1 Claim, 2 Drawing Figures

PROCESS FOR PRODUCING METAL RINGS

REFERENCE TO RELATED PATENTS

This application relates to rings used for sealing members as disclosed by U.S. Pat. No. 3,782,869.

BACKGROUND OF THE DISCLOSURE

Metal rings of the kind described are produced as a rule from annular strips, a separate strip being required for each ring. This procedure, however, especially when the rings are made of costly special material, is very uneconomical and expensive because of the unavoidable waste of material in cutting.

SUMMARY OF THE INVENTION

The object of the invention is to provide a process for producing metal rings of lower cost through better utilization of material.

In accordance with the process of the invention an annular strip is initially prepared. The outside diameter of the strip will correspond to the outside diameter of a strip after the strip has subsequently been deep-drawn, as required for the larger ring if produced singly. The strip is then deep-drawn and forms more or less parallel zones off-set stepwise in cross section and connected by way of roundings by a web extending obliquely outward, so that the web together with its adjacent zones already acquire the initial form of the neighboring branches of the C-shaped cross section of the rings. The deep-drawn strip is thereupon parted in a transverse plane, and finally the single strip parts thus performed are deep-drawn into finished rings having their final C-shaped cross-section.

By the proposed process, an intermediate drawing operation, preforms the cross-section of the rings from a single strip so that two rings can be produced at once using one strip. This mode of production makes it possible to reduce the outlay of material to approximately a half, so that compared to conventional procedures, a substantial reduction of material costs can be achieved, to great advantage especially when expensive materials are used.

Other details and features of the invention will be illustrated by way of example in the following description in conjunction with the drawing.

DETAILED DESCRIPTION

Figure 1:
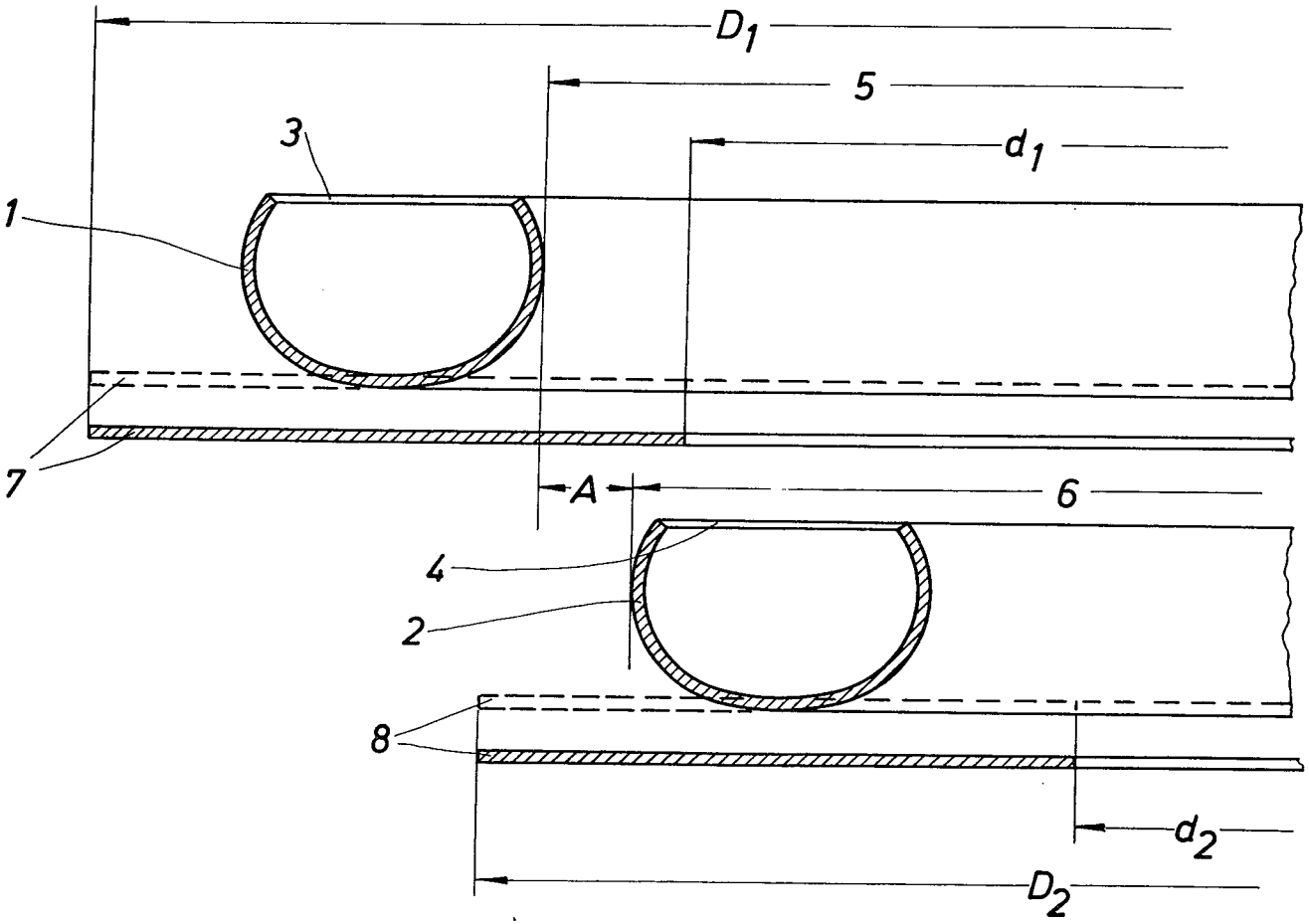
FIG. 1 shows two rings side by side in cross-section together with the strips required for their production by the conventional procedure, to an enlarged scale.

Reference is made first to FIG. 1, in which two metal rings 1 and 2 having a concave C-shaped cross-section are represented, with their respective annular apertures 3 and 4 pointing in axial direction. For the sake of illustration, the rings 1 and 2 are shown in staggered arrangement, although in actuality they are arranged side by side in pairs in a plane with a small radial interval, leaving a distance A between the outside diameter 6 of ring 2 and the slightly larger inside diameter 5 of ring 1. The production of ring 1 requires an annular strip 7 of outside diameter $D_1$ and inside diameter $d_1$, while ring 2 requires an annular strip 8 of outside diameter $D_2$ and inside a diameter $d_2$. In the representation shown, it is apparent that the outside diameter $D_2$ of strip 8 and the inside diameter $d_1$ of strip 7 of the original stock overlap by a good deal. This means that the production of rings 1 and 2 requires one strip each with corresponding scrap, representing added cost especially in the case of expensive materials.

Figure 2:
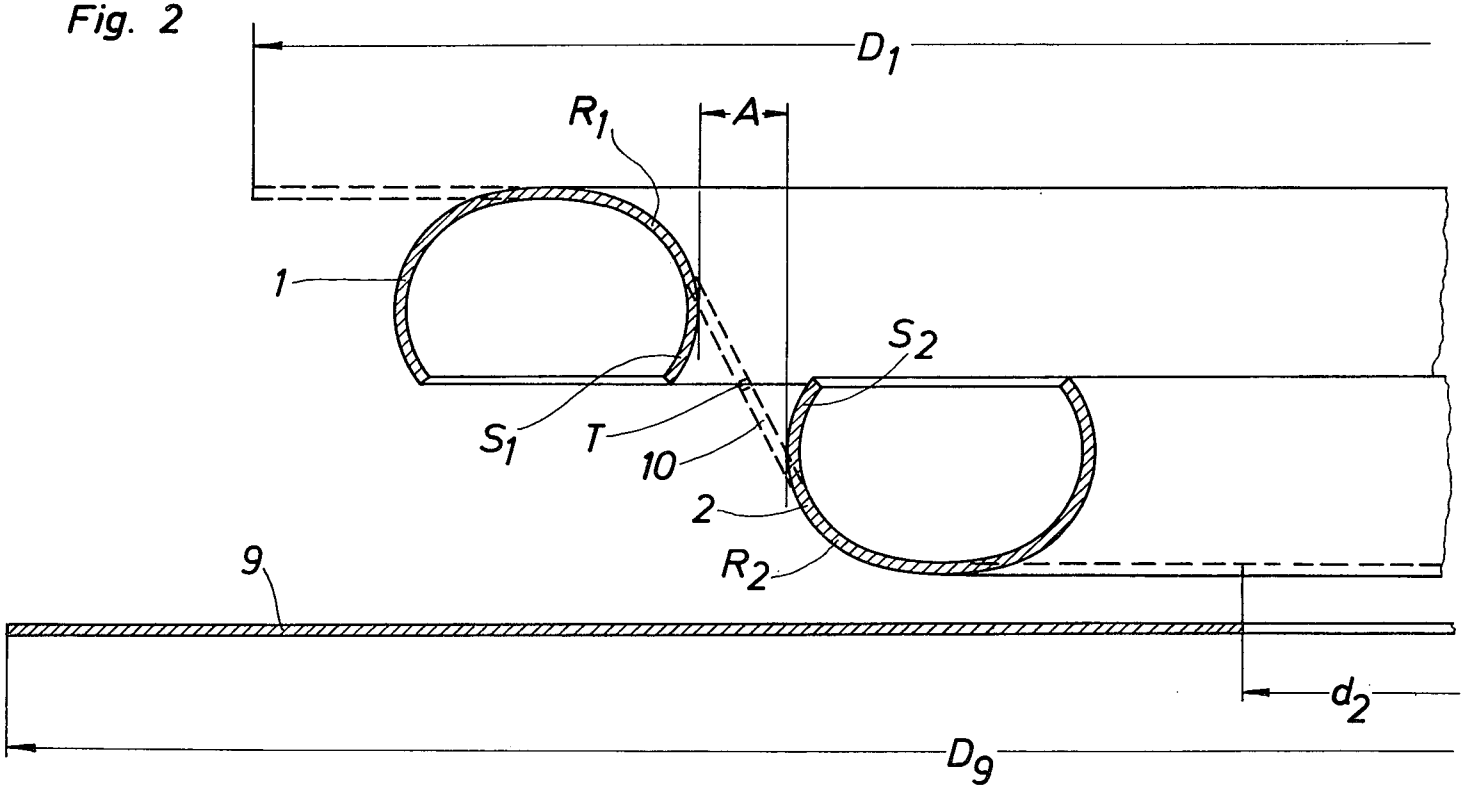
FIG. 2 shows two rings side by side in cross-section, produced by the process according to the invention, likewise to an enlarged scale.

FIG. 2 shows the process according to the invention, in which rings 1 and 2, for economical production, are fabricated from a single annular strip 9. The inside diameter of strip 9 equals the inside diameter $d_2$ of strip 8 in FIG. 1, while the outside diameter $D_9$ is slightly greater than the outside diameter $D_1$ of strip 7 in FIG. 1, to allow enough material for the subsequent operation of drawing strip 9, which will shrink the outside diameter $D_9$ to the size of the outside diameter $D_1$. In the course of the operation, strip 9 is first deep-drawn, forming a more or less step-shaped cross-section, as indicated by dotted lines. With allowance for the distance A to be left between the two rings 1 and 2 and the shape of rings 1 and 2, the roundings $R_1$ and $R_2$ simultaneously formed by the deep-drawing already provide the start for a portion of the C-shaped cross-sections in this operation, while the neighboring branches $S_1$ and $S_2$ of rings 1 and 2 will be formed from the central web 10. In this prefabricated state, the strip 9 is parted through the web 10 at its transverse median plane T. Then the parts of strip 9 thus obtained can be singly made into rings 1 and 2 by an additional pressing operation, bringing them into their final form with a C-shaped cross-section.

Instead of the annular strip 9, a disc-shaped blank may alternatively be used, the inside diameter $d_2$ being punched out in the course of the operation.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A process for production of two metal rings having a concave C-shaped cross-section, each open in axial direction, in particular for annular sealing members, the outside diameter of the one ring being slightly smaller than the inside diameter of the other ring, comprising the steps of providing an annular strip the outside diameter of which is larger than the outside diameter of a strip as required for the larger ring if produced singly and after the annular strip has subsequently been deep-drawn, will correspond to the outside diameter of a strip as required for the larger ring if produced singly and the inside diameter of which is equal to the inside diameter of a strip as required for the smaller ring if produced singly, preliminarily shaping the annular strip by deep-drawing the strip to initially form more or less parallel planar zones off-set step-wise in cross-section and connected by way of roundings by an intermediate web extending obliquely outward between the parallel zones, so that the web together with its adjacent zones already acquires the initial form of the neighboring branches of the C-shaped cross-sections of the rings, parting intermediate the roundings to form individual annular strip parts and finally shaping by deep-drawing the individual strip parts thus preformed into finished rings having their final C-shaped cross-section.

* * * * *